US005829636A

United States Patent [19]

Vuong et al.

[11] Patent Number: 5,829,636

[45] Date of Patent: Nov. 3, 1998

[54] ANTI-DRIP LIQUID DISPENSER

[75] Inventors: Nhon T. Vuong, Lombard; Jesse L. Aparicio, Berwyn, both of Ill.

[73] Assignee: Sloan Valve Company, Franklin Park, Ill.

[21] Appl. No.: 799,704

[22] Filed: Feb. 11, 1997

[51] Int. Cl.[6] ..... G01F 11/00

[52] U.S. Cl. ..... 222/63; 222/109; 222/642

[58] Field of Search ..... 222/63, 108, 109, 222/642, 643

[56] References Cited

U.S. PATENT DOCUMENTS

| | | | |
|---|---|---|---|
| 4,722,372 | 2/1988 | Hoffman et al. | 222/52 X |
| 4,989,755 | 2/1991 | Shiau | 222/63 |
| 5,235,214 | 8/1993 | Voung et al. | 222/52 X |
| 5,255,822 | 10/1993 | Mease et al. | 222/63 |
| 5,299,713 | 4/1994 | Saitoh | 222/63 X |
| 5,305,915 | 4/1994 | Kamysz et al. | 222/63 |
| 5,492,247 | 2/1996 | Shu et al. | 222/63 |

*Primary Examiner*—Kenneth Bomberg
*Attorney, Agent, or Firm*—Dorn, McEachran, Jambor & Keating

[57] ABSTRACT

A soap dispenser includes a soap supply, a motor driven pump connected by tubing to the soap supply and a soap output device connected by tubing to the motor driven pump. The electric drive circuit for operating the pump motor includes a sensor for detecting a user's hands positioned to receive soap from the output device. There is a forward motor control circuit connected to the sensor and to the pump motor and responsive to a start signal from the sensor to drive the pump motor in a forward direction to supply soap to the output device. There is a volume adjust circuit connected to the forward motor control circuit and to the sensor to provide a stop signal to the forward motor control circuit a predetermined time period after receipt of a start signal from the sensor. There is a reverse motor control circuit connected to the pump motor and to the volume adjust circuit and responsive to a stop signal from the volume adjust circuit to drive the pump motor in a reverse direction to reverse the flow of soap to the output device.

7 Claims, 1 Drawing Sheet

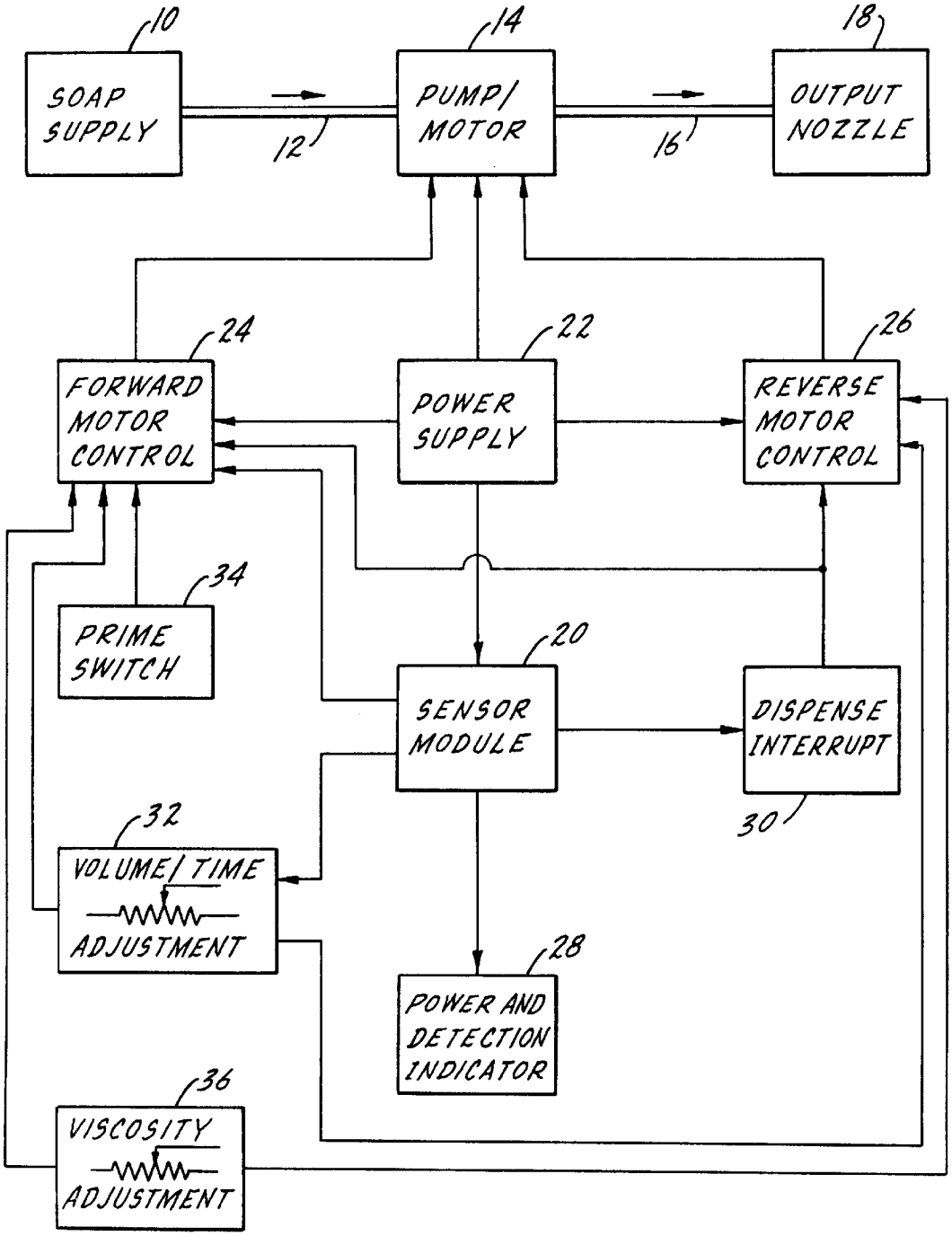
10
SOAP SUPPLY
12
14
PUMP/ MOTOR
16
18
OUTPUT NOZZLE
24
FORWARD MOTOR CONTROL
22
POWER SUPPLY
26
REVERSE MOTOR CONTROL
34
PRIME SWITCH
20
SENSOR MODULE
DISPENSE INTERRUPT
30
32
VOLUME/ TIME ADJUSTMENT
28
POWER AND DETECTION INDICATOR
36
VISCOSITY ADJUSTMENT

ANTI-DRIP LIQUID DISPENSER

THE FIELD OF THE INVENTION

The present invention relates to soap dispensers of the type commonly found in public washrooms and particularly to such devices which are automatically activated by a sensor positioned to detect the presence of a user's hands beneath the soap dispensing nozzle. Such sensors are commonly infrared devices, but may be otherwise. A common problem with such soap dispensers is that when the soap dispensing operation is terminated, either on the basis of time or the removal of the user's hands, there is some soap in the dispensing system which will drip from the nozzle, leaving an unwelcome soap residue beneath the dispensing nozzle.

The present invention provides an electric circuit to reverse the pump motor when the soap dispensing operation is terminated, either on the basis of time or because the user's hands have been removed. Reversal of the pump motor results in the soap directly at the dispensing nozzle being pulled back into the soap dispensing system, eliminating the common and undesirable dripping from the nozzle described above. The present invention further provides that reversal of the pump motor may be initiated either at the end of a timed soap dispensing cycle or prior to the time-out of the soap dispensing cycle if the user's hands are removed from beneath the sensor. Further, the invention provides for adjusting the volume of soap dispensed during a soap dispensing operation and for control of the power applied to the pump motor consistent with the viscosity of the soap being dispensed.

SUMMARY OF THE INVENTION

The present invention relates to liquid dispensers, particularly soap dispensers of the type commonly found in public washrooms and more particularly to an electric circuit for reversing the direction of pump rotation to prevent dripping from the soap dispensing nozzle after the termination of the soap dispensing cycle.

A primary purpose of the invention is a motor control circuit for a soap dispensing pump which includes a reverse motor control function at the termination of the soap dispensing operation.

Another purpose of the invention is a soap dispensing control circuit as described in which the reverse motor control function operates at the end of a timed soap dispensing cycle or at any intermediate termination of the soap dispensing cycle due to removal of the user's hands.

Another purpose of the invention is to provide a control circuit as described which can adjust the volume of soap dispensed during a complete soap dispensing cycle.

Another purpose is a soap dispensing control circuit as described which varies the power to the pump motor consistent with the viscosity of the soap or other liquid being dispensed.

Another purpose of the invention is to provide a soap dispensing control circuit as described including a prime switch which provides a timed operation of the pump motor in the forward direction to prime the soap dispensing tubes and nozzle.

Other purposes will appear in the ensuing specification, drawing and claims.

BRIEF DESCRIPTION OF THE DRAWINGS

The invention is illustrated in the attached block diagram of the soap dispensing system disclosed herein.

DESCRIPTION OF THE PREFERRED EMBODIMENT

The present invention relates to soap dispensers of the type commonly found in public washrooms and particularly to a sensor-operated soap dispensing system. Soap dispensing devices of this general type are shown in U.S. Pat. Nos. 5,295,655, 5,235,214 and 4,938,384, all owned by Sloan Valve Company of Franklin Park, Ill., the assignee of the present application. U.S. Pat Nos. 4,921,150 and 4,946,072 also show soap dispensers of the general type disclosed herein.

A principal problem with sensor-operated soap dispensers in which the sensor provides a signal to drive a pump motor, is that at the termination of the dispensing operation, there is a dripping of soap from the output nozzle. The present invention provides a means for eliminating this problem in that the pump motor is driven in a reverse direction when the dispensing cycle has been completed, whether it be on a timed basis or because the user's hands have been removed.

In the drawing, a soap supply is indicated at 10 and is connected by the conventional flexible soap tubing 12 to a peristalic motor driven pump 14. The pump 14 is connected by tubing 16 to an output nozzle 18 which will dispense the soap. Conventionally, there will be a sensor positioned at a location relative to the output nozzle to sense the presence of a user's hands beneath the nozzle. The sensor module is indicated at 20 and is a part of the overall electrical circuit controlling operation of the pump motor. An infrared sensor is satisfactory, but the invention should not be so limited.

The electrical circuit includes a power supply 22 which is connected to the pump motor, the sensor 20, a forward motor control circuit 24 and a reverse motor control circuit 26. The sensor module is also connected to a power and detection indicator circuit 28 which will display when the sensor is in a detection mode and when the system is powered up but currently unused. The detection circuit 28 may include a two-color LED or two separate LEDs, either type of indicator is satisfactory.

The sensor module 20 is also connected to a dispense interrupt circuit 30, to the forward motor control circuit 24 and to a volume/time adjustment circuit 32. The remaining circuits which make up the overall electrical control for the pump motor 14 include a prime switch 34 and a viscosity adjustment circuit 36.

The volume/time adjustment circuit 32 includes a potentiometer so that the time period of the normal cycle of soap dispensing may be adjusted. The viscosity adjustment circuit also includes a potentiometer to vary the voltage applied by the pump motor drive circuits.

The initiation of a dispensing cycle results from the sensor module 20 detecting the presence of a user's hands beneath the output nozzle 18. A start signal is sent from the sensor module 20 to the forward motor control circuit 24 and to the volume/time adjustment circuit 32. The forward motor control circuit 24 starts the pump motor operating in a forward direction to move soap from the soap supply to the output nozzle. The volume/time adjustment circuit 32 functions as a time clock in that it controls the time period during which the forward motor control circuit 24 will drive the pump motor in the forward direction. This time may be adjusted by the described potentiometer. Assuming the user's hands remain beneath the nozzle for the time period of circuit 32, the forward motor control circuit 24 will drive the pump motor in a forward direction for the entire period determined by circuit 32.

At the end of a normally timed cycle, as determined by volume/time adjustment circuit 32, there will be a signal sent from circuit 32 to forward motor control circuit 24, terminating the application of power from this circuit to the pump motor 14 and starting the application of power from reverse motor control circuit 26. Both motor control circuits are connected to circuit 32 so that when the forward motor control circuit 24 terminates power, a reverse motor control circuit applies power in the opposite polarity to drive the pump motor in the reverse direction to draw soap backward from the output nozzle into tubing 16.

In the event the user's hands are removed from beneath the output nozzle 18 prior to the termination of the time period set by volumeltime adjustment circuit 32, a signal will be sent from sensor 20 to the dispense interrupt circuit 30. This circuit will provide a signal which will stop the application of power from the forward motor control circuit 24 to the pump motor 14 and start the application of power to the pump motor 14 from reverse motor control circuit 26. The result is that the pump motor 14 will be driven in the reverse direction which again will have the result of drawing soap from the output nozzle 18 back into the supply line 16 to prevent any dripping from the output nozzle.

The circuit includes prime switch 34 which, when activated, will drive motor control circuit 24 for a predetermined period of time sufficient to insure that the supply lines have been primed with soap. Normally, the prime switch is utilized when the system is initially installed or when a new supply of soap is placed in the system. In either event it is necessary that the entire system including tubes 12 and 16, pump 14 and output nozzle 18 be primed for a dispensing operation. The time control of the prime switch is adequate so that the complete system will be primed, but soap will not be dispensed.

The circuit is completed by the viscosity adjustment circuit 36 which varies the voltage applied by either forward motor control circuit 24 or reverse motor control circuit 26 consistent with the viscosity of the soap or other liquid being dispensed. Typically, the viscosity adjustment 36 can vary the application of power from between 7 volts DC to 24 volts DC and this power, as adjusted, is applied by both the forward and reverse motor control circuits. The block diagram of the drawing discloses the invention in a functional format. In practice, the reverse motor control circuit may be a relay which reverses the polarity of the voltage applied by the forward motor control circuit to the pump motor.

The reverse time of the motor may vary from between 200 milliseconds to 400 milliseconds, depending upon the viscosity setting.

The invention provides a complete control system for a soap dispenser. Reversal of the pump motor eliminates the common problem of soap dripping from the output nozzle. The cycle time for operation of the soap dispenser is adjustable and pump motor reversal is assured in the event a user's hands are removed prior to completion of a normal dispensing cycle. The power applied to the pump motor is adjustable to account for variations in the viscosity of the soap. The sensor includes indicators which are useful for maintenance personnel to determine whether the system is operating properly.

Whereas the preferred form of the invention has been shown and described herein, it should be realized that there may be many modifications, substitutions and alterations thereto.

The embodiments of the invention in which an exclusive property or privilege is claimed are defined as follows:

1. A soap dispenser including a soap supply, a motor driven pump connected by tubing to the soap supply, a soap output device connected by tubing to the motor driven pump, electric circuit means for operating said pump motor including a sensor for detecting a user's hands positioned to receive soap from the output device, a forward motor control circuit connected to said sensor and pump motor and responsive to a start signal from said sensor to drive said pump motor in a forward direction to supply soap to said output device, a volume adjust circuit connected to said forward motor control circuit and to said sensor to provide a stop signal to said forward motor control circuit a predetermined time period after receipt of a start signal from said sensor, and reverse motor control means connected to said pump motor and said volume adjust circuit and responsive to a stop signal from said volume adjust circuit to drive said pump motor in a reverse direction to reverse the flow of soap to said output device.

2. The soap dispenser of claim 1 including an interrupt circuit connected to said sensor, said forward motor control circuit, and said reverse motor control means, and responsive to a signal from said sensor indicating removal of a user's hands to provide a stop signal to said forward motor control circuit and a start signal to said reverse motor control means if the time period of said volume adjust circuit has not been completed.

3. The soap dispenser of claim 1 wherein said volume control circuit includes means for adjusting the time period thereof.

4. The soap dispenser of claim 1 including a viscosity adjustment circuit connected to said forward motor control circuit to control the application of power to said pump motor.

5. The soap dispenser of claim 4 wherein said viscosity adjustment circuit is also connected to said reverse motor control means to control the application of power to said pump motor when operating in the reverse direction.

6. The soap dispenser of claim 1 including a prime circuit connected to said forward motor control circuit to provide a drive signal therefor for a predetermined time period to prime the tubing connecting said soap supply, pump and output nozzle with soap.

7. The soap dispenser of claim 1 wherein said sensor includes indicating means to show the application of power thereto.

* * * * *